US010350503B2

(12) United States Patent
Freedman et al.

(10) Patent No.: US 10,350,503 B2
(45) Date of Patent: Jul. 16, 2019

(54) AMUSEMENT PARK CAPSULE RIDE

(71) Applicant: Universal City Studios LLC, Universal City, CA (US)

(72) Inventors: Daniel Matthew Freedman, Ocoee, FL (US); David Gerard Majdali, Orlando, FL (US); Nathanael Gordon White, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 10 days.

(21) Appl. No.: 15/714,629

(22) Filed: Sep. 25, 2017

(65) Prior Publication Data

US 2019/0091587 A1 Mar. 28, 2019

(51) Int. Cl.

| | |
|---|---|
| ***A63G 31/08*** | (2006.01) |
| ***A63G 23/00*** | (2006.01) |
| *A63G 31/16* | (2006.01) |

(52) U.S. Cl.

CPC ..... *A63G 31/08* (2013.01); *A63G 23/00* (2013.01); *A63G 31/16* (2013.01)

(58) Field of Classification Search

CPC . A63G 1/00; A63G 1/04; A63G 21/00; A63G 27/02; A63G 31/00; A63G 31/02; A63G 31/16

USPC ..... 472/59–62, 130, 43–47; 434/30, 34, 46, 434/55, 59

See application file for complete search history.

(56) References Cited

U.S. PATENT DOCUMENTS

| | | | | |
|---|---|---|---|---|
| 5,193,462 | A | 3/1993 | Marcu | |
| 5,558,582 | A * | 9/1996 | Swensen | A63G 31/16 472/43 |
| 5,716,281 | A | 2/1998 | Dote | |
| 5,775,226 | A | 7/1998 | Futami et al. | |
| 6,095,926 | A * | 8/2000 | Hettema | A63G 31/16 104/85 |
| 6,220,171 | B1 | 4/2001 | Hettema et al. | |
| 6,406,299 | B1 * | 6/2002 | Murao | B25J 9/104 434/29 |
| 6,910,971 | B2 * | 6/2005 | Alsenz | A63G 1/24 434/55 |
| 7,770,523 | B2 | 8/2010 | Kovac | |
| 8,241,133 | B1 | 8/2012 | Lewis et al. | |
| 8,356,996 | B2 * | 1/2013 | Mayrhofer | G09B 9/12 434/55 |

(Continued)

FOREIGN PATENT DOCUMENTS

| | | |
|---|---|---|
| CN | 202590348 U | 12/2012 |
| CN | 203507510 U | 4/2014 |

(Continued)

OTHER PUBLICATIONS

PCT/US2018/050607 International Search Report and Written Opinion dated Nov. 15, 2018.

*Primary Examiner* — Kien T Nguyen
(74) *Attorney, Agent, or Firm* — Fletcher Yoder, P.C.

(57) ABSTRACT

A capsule ride system includes a capsule, where the capsule includes a drum, which may include a curved annular wall that may define a chamber. The capsule also includes a platform that may fit within the chamber and that supports a restraint for a passenger. The system further includes a drive system capable of driving rotation of the capsule about a central axis of the capsule and driving forward and/or rearward movement of the capsule along a track.

23 Claims, 6 Drawing Sheets

(56) References Cited

U.S. PATENT DOCUMENTS

| | | | |
|---|---|---|---|
| 2014/0329610 | A1 | 11/2014 | Theilgaard |
| 2014/0333507 | A1 | 11/2014 | Welck |
| 2016/0166942 | A1 | 6/2016 | Fisher |
| 2016/0229416 | A1 | 8/2016 | Bambrogan et al. |

FOREIGN PATENT DOCUMENTS

| | | | |
|---|---|---|---|
| JP | 3003979 | U | 11/1994 |
| WO | 2014129928 | A1 | 8/2014 |
| WO | 2016069494 | | 5/2016 |

* cited by examiner

AMUSEMENT PARK CAPSULE RIDE

FIELD OF DISCLOSURE

The present disclosure relates generally to the field of amusement parks. More particularly, embodiments of the present disclosure relate to systems and methods for amusement park rides featuring rotation about a central axis, along with forward and/or rearward motion.

BACKGROUND

Theme park or amusement park ride attractions have become increasingly popular. Some traditional rides may include multi-passenger vehicles that travel along a fixed path. In addition to the excitement created by the speed or change in direction of the vehicles as they move along the path, the vehicles themselves may generate special effects, such as sound and/or motion effects. However, in these traditional rides, the vehicles may travel only in a forward and/or rearward direction along the path. Accordingly, there is a need to develop new rides to provide passengers with unique motion and visual experiences.

BRIEF DESCRIPTION

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In one embodiment, a system may include a capsule, where the capsule may include a drum, which may include a wall that may define a chamber. The capsule may also include a platform that may fit within the chamber and that may support a restraint for a passenger. The system may further include a drive system capable of driving rotation of the capsule about a central axis of the capsule and driving forward or rearward movement of the capsule along a track.

In one embodiment, a system may include a track, a capsule with a passenger restraint and a screen configured to display an image to the passenger supported by the restraint, and a drive system capable of driving rotation of the capsule about a central axis of the capsule and driving forward or rearward movement of the capsule along the track of the system.

In one embodiment, a method may include positioning a platform supporting a passenger restraint within a chamber defined by a wall of a capsule, driving forward or rearward movement of the capsule along a track using a drive system, and driving rotation of the capsule about a central axis of the capsule using the drive system.

DRAWINGS

These and other features, aspects, and advantages of the present disclosure will become better understood when the following detailed description is read with reference to the accompanying drawings in which like characters represent like parts throughout the drawings, wherein.

Figure 1:
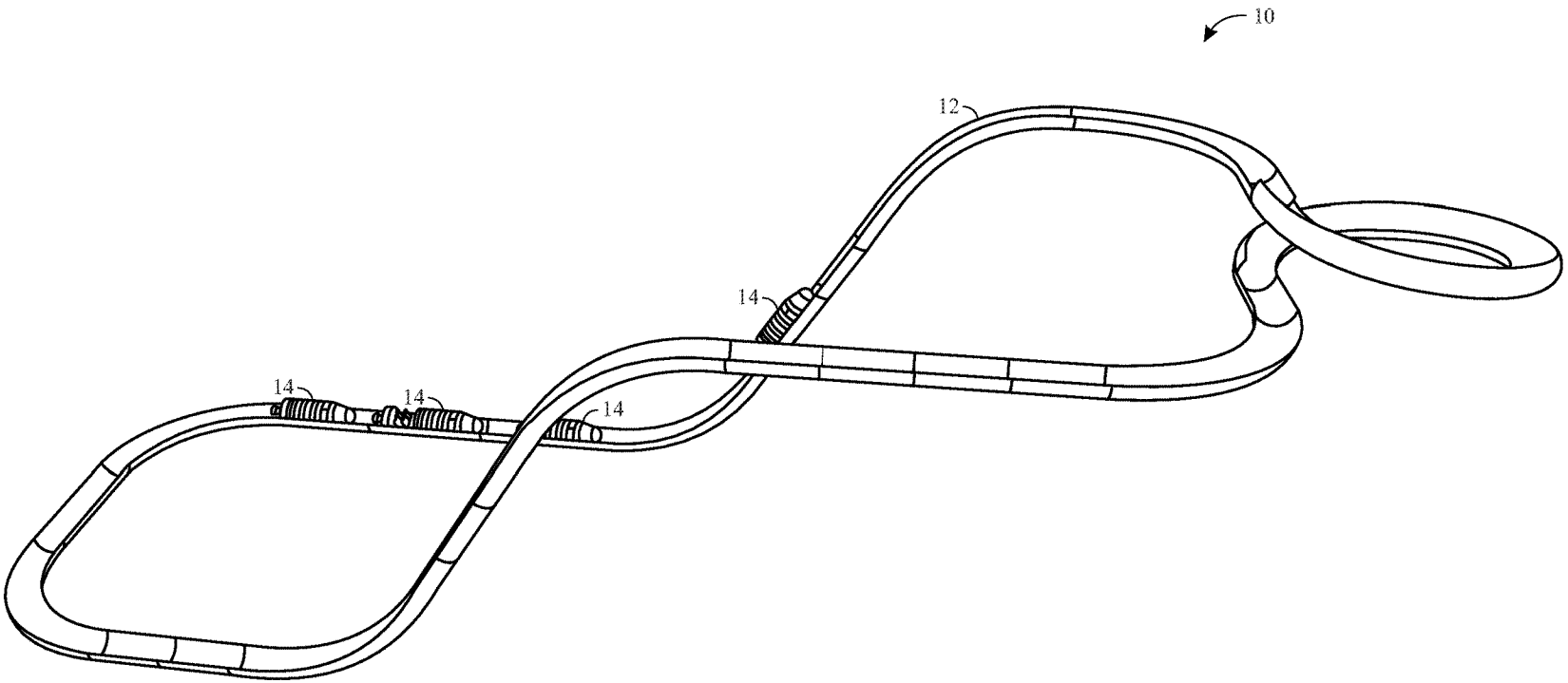
FIG. 1 is a perspective view of a capsule ride system, in accordance with an embodiment of the present disclosure.
Figure 5:
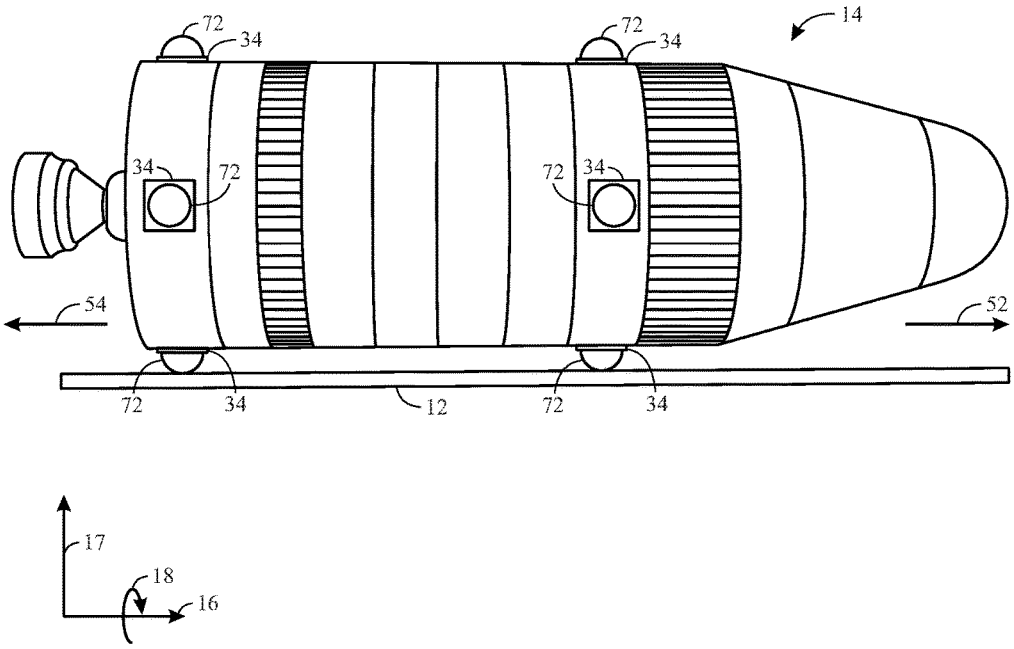
Figure 6:
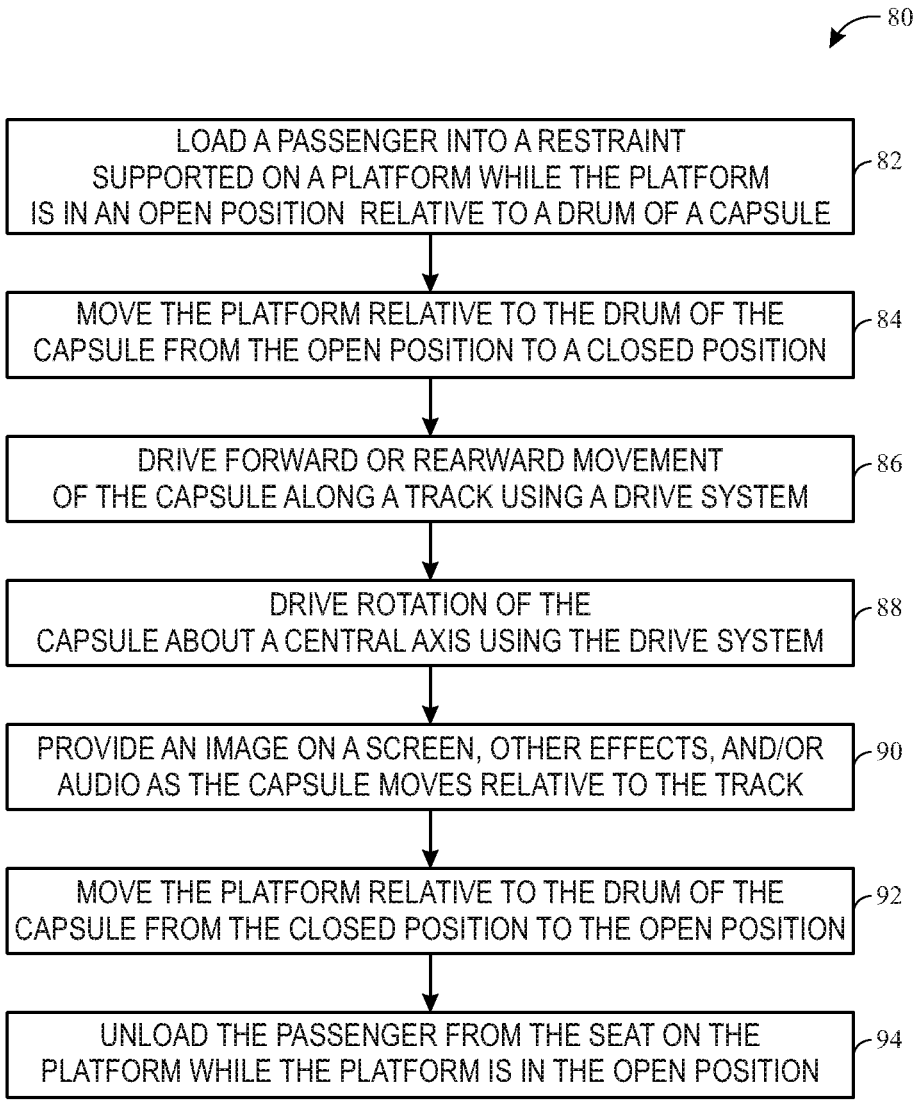

FIG. 5 is a side view of a capsule that may be used in the capsule ride system of FIG. 1, wherein the capsule includes multiple rolling elements disposed circumferentially about a radially outer surface of the capsule, in accordance with an embodiment of the present disclosure; and FIG. 6 is a block diagram of a method of operating the capsule ride system of FIG. 1, in accordance with an embodiment of the present disclosure.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Further, to the extent that certain terms such as annular, spherical, radial, axial, circumferential, parallel, and so forth are used herein, it should be understood that these terms allow for certain deviations from a strict mathematical definition, for example to allow for deviations associated with manufacturing imperfections and associated tolerances.

Embodiments of the present disclosure are directed to amusement park ride attractions. More specifically, embodiments are directed to a capsule ride system having a capsule configured to move along a track. During a ride cycle of the capsule ride system, passengers may enter onto a platform designed for passenger restraint while the capsule is in an open position. The platform may move along a platform track internal to a drum (e.g., circular or octagonal cylinder) of the capsule to close the capsule. In one embodiment, the platform is locked into place within the drum. Once the capsule is in a closed position, the capsule may proceed to drive forward and/or rearward along the track. Further, the capsule ride system may include a drive system to drive rotation of the capsule about a central axis of the capsule. Because the platform holding the passengers may lock into the drum, the drive system may drive both the drum and the platform to rotate. As such, the passengers may experience rotation around a central axis simultaneously with and/or separately from forward and/or rearward motion during the ride cycle. Further, media and/or a narrative associated with the motion of the capsule may create a motion simulator experience that allows passengers to simultaneously imagine the sights, sounds, and motions of an experience, such as flying a plane in a barrel-roll. At the conclusion of the ride cycle, the platform may move along the platform track internal to the drum to open the capsule and enable passengers to exit the capsule.

FIG. 1 illustrates a capsule ride system 10. The capsule ride system 10 may include a track 12, which may resemble an open trough. The track 12 may be assembled in various configurations. For example, in one embodiment, the track may form hills, dips, and/or turns, as depicted in FIG. 1. In one embodiment, the track 12 may be configured in a spiral or corkscrew arrangement, and/or it may create a loop (e.g., continuous or closed loop). Further, in one embodiment, the construction of the track 12 may utilize tube-like sections (e.g., annular sections) resembling hollow cylinders in conjunction with and/or instead of open trough sections. The illustrated track 12 includes a curved wall; however, it should be appreciated that the track 12 may have any suitable geometry, such as a flat wall or flat portions. Further, the capsule ride system 10 may include one or more capsules 14 for use with the track 12. In one embodiment, the capsules 14 have a cylindrical shape that fits within and generally corresponds to the curvature of a radially-inner surface of the track 12. In one embodiment, the capsules 14 may move in a forward and/or rearward direction along the track 12, as well as rotate about a central axis of the capsule 14. In one embodiment, the track 12 may include an area to load and unload passengers, which may involve opening the capsule 14, as will be described in greater detail below.

Figure 2:
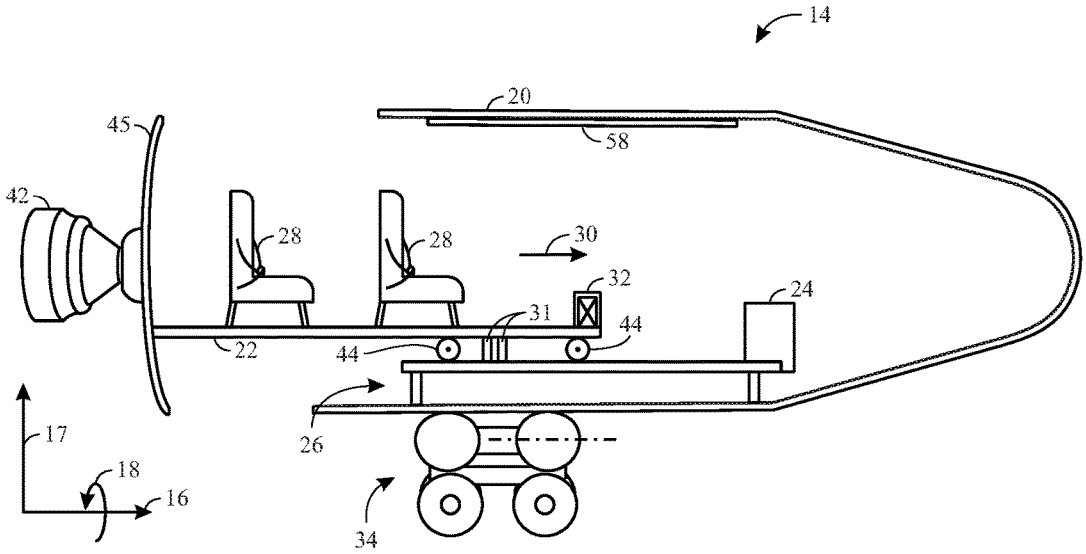
FIG. 2 is a cross-sectional side view of a capsule that may be used in the capsule ride system of FIG. 1, wherein the capsule is in an open position, in accordance with an embodiment of the present disclosure.
Figure 3:
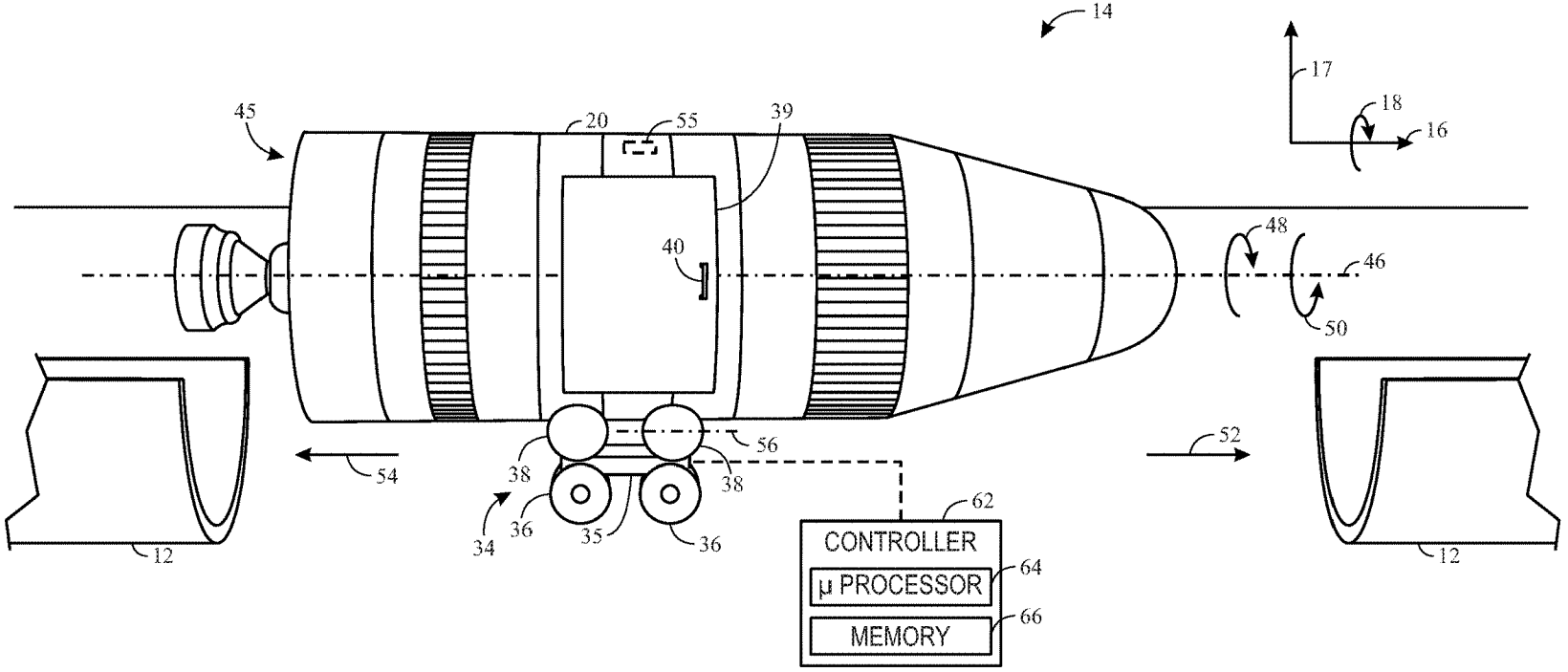
FIG. 3 is a perspective view of the capsule of FIG. 2, wherein the capsule is in a closed position, in accordance with an embodiment of the present disclosure.

FIG. 2 provides an illustration of the capsule 14 in an open position. To facilitate discussion, the capsule 14 and its components may be described with reference to an axial axis or direction 16, a radial axis or direction 17, and a circumferential axis or direction 18. In the open position, the capsule 14 may allow passengers to enter onto a platform 22 that the capsule 14 may support on a platform track 26 within a drum 20. The drum 20 of the capsule 14 may have a curved annular wall that defines a chamber within the capsule 14. The platform track 26 may include rails capable of supporting one or more platform wheels 44 (e.g., wheels, slides). The platform wheels 44 may be capable of securing to and/or moving along the platform track 26. For example, the platform wheels 44 may engage with the platform track 26 such that the platform wheels 44 may remain secured to the platform track 26 in the event that the platform 22 is inverted (e.g., the capsule 14 is rotated). That is, the platform wheels 44 may contain extensions that may lock into the platform track 26. Additionally or alternatively, the platform wheels 44 may roll between a set of parallel rails on the platform track 26 so that each platform wheel 44 is secured between an upper and lower rail of the platform track 26. In one embodiment, the platform 22 may contain a mechanism (e.g., a set of columns) that may couple to the drum 20 to secure the platform 22 in place while the capsule 14 rotates. Further, the platform 22 may contain restraints 28 to secure passengers. The restraints 28 may include a seat, a seat belt, a lap bar, an overhead restraint pulled down to cover the torso, and/or any combination thereof to restrain or support each passenger as the capsule 14 travels along the track 12. Further, the number of restraints 28 on the platform 22 may determine the size of the chamber defined by the drum 20 and the resulting dimensions of the capsule 14. As such, increasing the number of restraints 28 in a row may increase the radius of the capsule 14, while increasing the number of rows of restraints 28 may increase the length of the capsule 14. After the passengers are loaded and restrained securely, the platform 22 may move along the platform track 26 in the direction of arrow 30 to a closed position, as shown in FIG. 3. In one embodiment, a platform drive system 32 may drive the movement of the platform 22 along the platform track 26. For example, the platform drive system 32 may include one or more motors configured to drive rotation of the platform wheels 44, thereby driving the movement of the platform 22. In one embodiment, the platform 22 may couple to a mechanical winch that may be used to control movement of the platform 22 along the platform track 26.

Further, to lock the capsule 14 into a closed position, thereby securing the platform 22 inside the drum 20 and sealing the chamber of the drum 20, the capsule 14 may have a lock mechanism 24. The lock mechanism 24 may include a mechanical lock and key configuration to securely lock the platform 22 into the drum 20. In one embodiment, the lock mechanism 24 may be driven by motors. Additionally, or in the alternative, the lock mechanism 24 may utilize a magnetic and/or electro-magnetic locking system. For example, in one embodiment, the lock mechanism 24 may contain an electro-magnet coupled to the platform 22 and/or the drum 20. When the electro-magnet is powered, it may lock the platform 22 in place in the drum 20 by utilizing magnetic forces. In one embodiment, the lock mechanism 24 may also include a biasing member and/or a failsafe mechanism to drive the platform 22 in a direction opposite arrow 30 from the closed position to the open position in case of power failure, mechanical issues, and/or the like. For example, in one embodiment, the capsule 14 may contain a mechanical lever coupled to the lock mechanism 24 that may be utilized to disengage the platform 22 from the drum 20.

As further illustrated by FIG. 2, in one embodiment, actuators 31 may couple to the platform 22 to cause motion of the platform 22 relative to the capsule 14. To couple to the platform 22, the actuators 31 may engage with the platform 22 once the platform 22 is securely locked into the drum 20. As such, as the platform 22 moves along the platform track 26 in the direction of arrow 30 to the closed position, the platform 22 may slide over the actuators 31. In one embodiment, actuators 31 may cause the platform 22 to shake (e.g., vibrate) and/or tilt. The actuators 31 may further cause the platform 22 to shift along the axial axis or direction 16, the radial axis or direction 17, the circumferential axis or direction 18, or a combination, thereof. As such, the platform 22 may be repositioned. Thus, in one embodiment, as the capsule 14 rotates or moves along the track 12, the platform 22 may additionally or alternatively move. Further, it should be appreciated that the actuators 31 may be positioned in any suitable location to cause motion of the platform 22. In one embodiment, for example, the actuators 31 may additionally or alternatively be located beneath and/or within the platform track 26.

In one embodiment, a rear panel 45 is coupled to the platform 22. Further, the rear panel 45 may support a battery 42. The battery 42 may provide power to components of the capsule 14. These components may include the lock mechanism 24, the platform drive system 32, and additional components that will be discussed in further detail. The additional components may include, for example, a drive system 34 provided to drive forward, rearward, and/or rotational movement of the capsule 14 and/or one or many screens 58 that provide media to passengers within the drum 20, among other things. In one embodiment, the battery 42 may be configured to charge via induction. As such, inductive charging pads and/or other charging components may be incorporated into the track 12 to charge the battery 42 while the capsule 14 is engaged with the track 12. These pads may be localized in a single area of the track 12, such as a passenger loading zone, so that the battery 42 may charge while the capsule 14 is stationary (e.g., while passengers are loaded onto the platform 22). Thus, the capsule 14 may remain on the track 12 to charge its battery 42, and as such, the capsule 14 may complete multiple ride cycles with its components powered by a periodically recharged battery 42. Additionally, or in the alternative, the capsule ride system 10 may contain a capsule charging station separate from the track 12 used in the ride cycle. The charging station may contain inductive charging pads and/or components to charge the capsule 14 via wireless and/or wired charging, respectively. In one embodiment, the capsule 14 may be removed from the track 12 to charge in the charging station and may be returned to the track 12 after the battery 42 has at least enough charge for the capsule 14 to complete a ride cycle.

As noted above, the platform 22 may travel in the direction of arrow 30 relative to the drum 20 to transition the capsule 14 from the open position shown in FIG. 2 to the closed position shown in FIG. 3. In FIG. 3, a portion of the track 12 has been removed so that the capsule 14 is in full view. In the closed position, the rear panel 45 contacts (e.g., is recessed within) the drum 20 (e.g., an annular surface at a rearward end of the drum 20), and the platform 22 is enclosed within the chamber defined by the rear panel 45 and the drum 20. Once the capsule 14 is in the closed position, the capsule 14 may begin to move along the track 12 of the capsule ride system 10. The drive system 34 may drive the movement of the capsule 14 in a forward direction 52 and/or rearward direction 54, along the axial axis 16. Additionally or alternatively, the drive system 34 may rotate the capsule about its central axis 46 (e.g., a central longitudinal or axial axis).

Additionally or alternatively, in one embodiment, a door 39 may be provided in a wall (e.g., a side wall) of the capsule 14 to facilitate ingress or egress of passengers. As such, the door 39 may be utilized while the platform 22 is locked within the drum 20, and/or the door may be utilized in one embodiment in which the platform 22 is fixed relative to the drum 20 (e.g., the platform 22 is not moveable and/or the capsule 14 is devoid of the platform track 26). That is, the door 39, when opened, may allow passengers into and out of the drum 20 of the capsule 14. The door 39 may sit flush to an outer wall of the drum 20 of the capsule 14 and may contain a handle 40 flush to the outer wall (i.e., not protruding radially outwardly from the outer wall) so that the door may not interfere with the drive system and/or the motion of the capsule 14.

In one embodiment, the drive system 34 may include a bogie 35 (e.g., chassis or frame) and a first rolling element 38, such as spherical tires. The bogie 35 may resemble a cart. The bogie 35 may support motors (e.g., spherical induction motors) and coupling elements that drive rotation of the first rolling element 38 and a second rolling element 36, such as spherical tires or wheels. In one embodiment, the drive system 34 may contain separate systems to drive the rotation of the first rolling element 38 and the second rolling element 36, respectively. Further, different types of systems may be used to drive each of the rolling elements (i.e., the first rolling element 38 and the second rolling element 36). For example, the first rolling element 38 may include spherical tires, and the drive system 34 may include spherical induction motors and coupling elements suitable to drive the motion of the first rolling element 38 in any direction. The spherical induction motors may include curved inductors configured to cause the first rolling element 38 to rotate in any direction. The second rolling element 36 may, for example, be a wheel coupled to different coupling elements in the drive system 34 and a separate motor configured to rotate the second rolling element 36 in the forward direction 52 and/or rearward direction 54. In one embodiment, the first rolling element 38 may make contact with a radially-outer surface (e.g., curved annular surface) of the drum 20 to drive rotation of the capsule 14. The capsule may rotate in a first direction 48 or a second direction 50, opposite the first direction 48, about the central axis 46 of the drum 20. For example, as the drive system 34 controls the motors to rotate the first rolling element 38 in the first direction 48 about a central axis 56 (e.g., a central longitudinal or axial axis) of the first rolling element 38, the capsule 14 may rotate in the second direction 50 about its central axis 46. Likewise, as the first rolling element 38 spins in the second direction 50, the capsule 14 may rotate in the first direction 48. Further, in one embodiment, the capsule 14 may further include a counter-balance 55 (e.g., weight) to aid in balancing the capsule 14 during rotation and facilitating this rotation of the capsule 14, while alleviating stresses on the drive system 34 and its components (e.g., the bogie 35, the first rolling element 38, and the second rolling element 36).

While the first rolling element 38 and the second rolling element 36 are shown as spherical tires, it should be appreciated that the first rolling element 38 and/or the second rolling element 36 may be motor-driven tires (e.g., ring-shaped tires mounted on an axle driven by a motor) oriented relative to the capsule 14 to drive forward and/or rearward motion and/or rotation.

Further, to drive the forward 52 and/or rearward 54 movement of the capsule 14, the drive system 34 may control motors coupled to the second rolling element 36 that is in contact with a surface (e.g., a radially-inner surface of a curved wall) of the track 12. In one embodiment, the drive system 34 may additionally or alternatively incorporate water, air, magnets, and/or other driving forces to propel the forward 52 and/or rearward 54 motion of the capsule 14. For example, in one embodiment, the capsule 14, along with the first rolling element 38 used to rotate the capsule 14, may be supported on a raft driven forward 52 or rearward 54 by a stream of water in place of the illustrated bogie 35.

In one embodiment, the rolling elements 38 and/or 36 may additionally or alternatively be coupled to the track 12. For example, one or many portions of the track 12 may contain rolling elements 36 and/or 38 that cause the capsule to move forward 52 and/or rearward 54 and/or to rotate in the first 48 or second direction 50 about the central axis 46 of the capsule 14, respectively. In such embodiments, a drive system (e.g., having motors) may be provided to drive the motion of the rolling elements 38 and/or 36.

To control the motion of the capsule 14 as it moves forward 52, rearward 54, and/or rotates in a first 48 or second direction 50, the drive system 34 may be coupled to a controller 62 (e.g., electronic controller). The controller 62 may comprise suitable processing and memory components, such as a microprocessor 64 and a memory 66. The controller 62 may provide logic and/or executable instructions to affect an operation of the motors in the drive system 34, thereby driving the rotation of the first rolling element 38 and/or second rolling element 36 and corresponding motion of the capsule 14. In one embodiment, the controller 62 may be communicatively coupled to the platform drive system 32, as well as any other suitable components in the capsule ride system 10.

Figure 4:
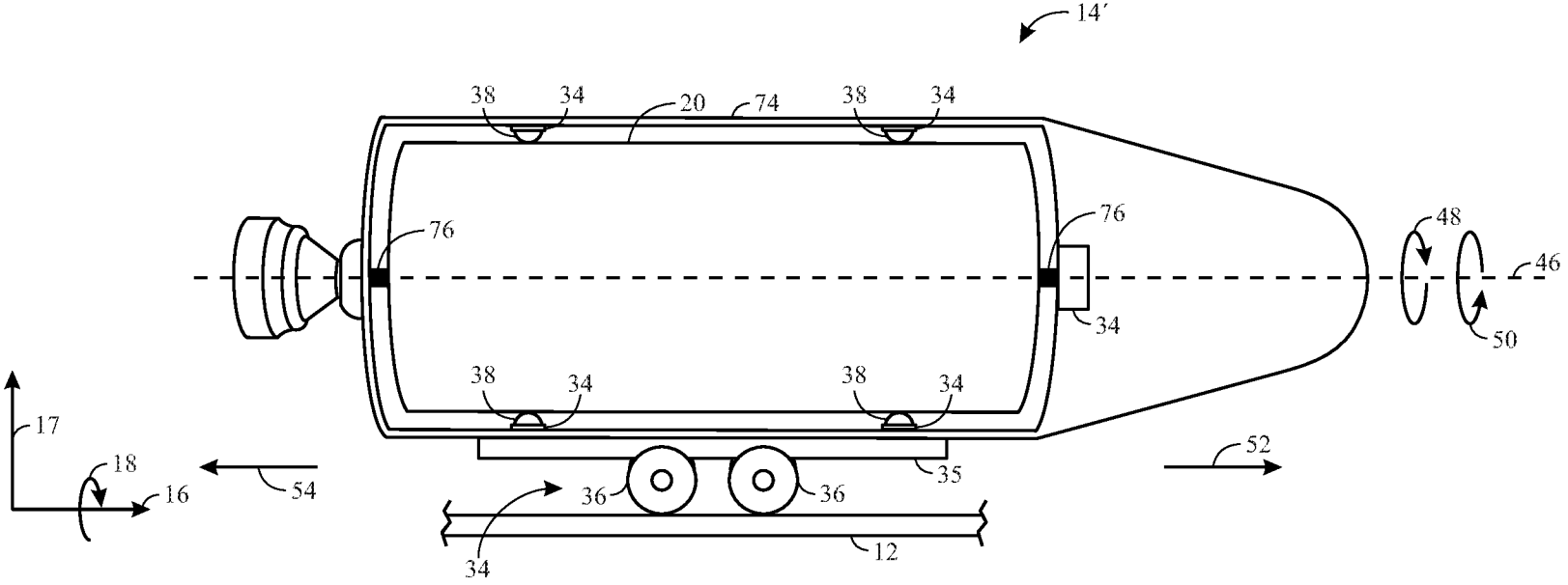
FIG. 4 is a side view of a capsule that may be used in the capsule ride system of FIG. 1, wherein the capsule includes an additional drum disposed within the capsule, in accordance with an embodiment of the present disclosure.

In one embodiment, as illustrated by FIG. 4 a capsule 14' may include the drum 20 disposed within an additional drum 74 (e.g., annular drum). As such, the drive system 34, may enable the first rolling element 38 to drive rotation of the drum 20, while the second rolling element 36 may drive the movement of the capsule 14' in a forward direction 52 and/or a rearward direction 54. In such an embodiment, the drive system 34 may couple to an inner surface of the additional drum 74. The first rolling element 38 coupled to the drive system 34 may contact the radially-outer surface of the drum 20 to drive rotation of the drum 20. Additionally or alternatively, the drive system 34 may operatively couple to an axle 76 coupled to the drum 20. The drive system 34 may include motors configured to rotate the axle 76 and the drum 20 in a first direction 48 and/or a second direction 50 about the central axis 46. The drive system 34 may further include the bogey 35 coupled to a radially-outer surface of the additional drum 74. The bogey 35 may support the second rolling element 36, which may contact the radially-inner surface of the track 12, to enable movement of the capsule 14' in the forward direction 52 and/or the rearward direction 54 along the track 12. As such, the rotation of the drum 20 may be driven separately from the movement of the capsule 14'. However, passengers within the drum 20 may experience both the rotation of the drum 20 and the motion of the capsule 14' along the track 12.

FIG. 5 displays one embodiment of the capsule 14 and the drive system 34. In one embodiment, the drive system 34 may include rolling elements 72 coupled to the radially outer surface of the capsule 14. The rolling elements 72 may be positioned at discrete locations spaced circumferentially about the drum 20 and may extend radially outwardly from the drum 20 to contact the radially inner surface of the track 12. In one embodiment, the rolling elements 72 may include spherical tires actuated by, for example, a spherical induction motor. Thus, with spherical induction motors incorporated in the drive system 34, the drive system 34 may cause the rolling elements 72 to rotate in any direction. As the rolling elements 72 may rotate along the track 12 in any direction, the capsule 14 may propel forward 52, rearward 54, and/or rotate about the central axis 46. For example, to move the capsule 14 in the forward direction 52, the drive system 34 may rotate the rolling elements 72 in the forward direction 52 along the axial axis 16. To rotate the capsule about the central axis 46, the drive system 34 may rotate the rolling elements 72 along the circumferential axis 18. To rotate the capsule 14 about the central axis 46 while moving the capsule 14 in the forward direction 52, the drive system 34 may rotate the rolling elements 72 along a vector between the axial axis 16 and circumferential axis 18. Further, with rolling elements 72 placed in multiple locations along the radially outer surface of the capsule 14, the capsule 14 may rotate about the central axis 46 in both open, trough-like portions of the track 12, as well as closed, tube-like portions of the track 12.

Further, with reference to FIG. 2, to enhance the experience of the motion of the capsule 14 and/or the platform 22, the motion may be associated with the narrative of a movie and/or media. To do so, in one embodiment, the drum 20 may contain one or more screens 58 positioned within it to display images. These screens 58 may be curved and/or coupled to the inner surface of the drum 20 so that the displayed images may surround the passengers to create an immersive media experience. The screens 58 may include any suitable type of display, such as a liquid crystal display (LCD), plasma display, or an organic light emitting diode (OLED) display, for example. The chamber of the capsule 14 may also contain speakers and/or devices suitable to deliver audio to passengers. The audio devices may be coupled to the drum 20, the platform 22, and/or any suitable location. Thus, the capsule 14 may provide media timed to correspond to the motion of the capsule 14 and/or the motion of platform 22. As such, the passengers may feel like they are in an airplane, spaceship, and/or any other suitable narrative. For example, the capsule 14 may move forward 52 up a hill on the track 12, as the screens 58 display images that relate to a narrative of a plane during take-off. As the capsule 14 begins to rotate along the central axis 46, the media may correspond to a plane maneuvering a barrel-roll, so that passengers receive an immersive motion and media experience of a narrative, such as a plane in a chase. Further, as the actuators 31 shake the platform 22, for example, the media may correspond to the plane experiencing turbulence.

Additionally or alternatively, passenger-controlled customization of the capsule ride system 10 may enhance the passengers' experience of the capsule ride system 10. To customize the capsule ride system 10, users (i.e., ride operators and/or ride passengers) may provide inputs (e.g., via an input device) to control parameters related to operation of the capsule 14 during a ride cycle. These parameters may enable users to adjust the intensity of the ride by controlling one or more factors, such as the speed at which the capsule 14 moves in a forward direction 52 and/or rearward direction 54, the speed at which the capsule 14 rotates about the central axis 46, and/or how frequently the capsule 14 rotates about the central axis 46, among other factors. Further, the user may be able to select (e.g., via an input device) the type of media provided to the passengers during the ride cycle. For example, users may select the narrative and/or theme of images and/or other media that may be coupled to the motion of the ride. Thus, a user may customize the capsule ride system 10 so that the total experience of the capsule's 14 motion and media may be flexible and personalized.

To facilitate customization and/or updates to the ride experience, the controller 62 may be configured to receive an input from an input device and to control a parameter of the capsule ride system 10 based on the input. The input device may comprise any suitable type of display coupled to a device suitable to make selections, such as a touch screen or a keyboard. Further, the input device may be accessible to a ride operator and/or a ride passenger while positioned in the restraint 28, for example. In one embodiment, the platform 22 within the capsule 14 may contain one or many input devices so that a passenger may control inputs provided to the controller 62 to affect a parameter of the capsule ride system 10. For example, an input may instruct the controller 62 to display media related to an airplane in flight on the screen 58 within the drum 20. Alternatively, the input may instruct the controller 62 to display media related to a spaceship flying in space on the screen 58 within the drum 20. Further, the controller 62, may communicate with the drive system 34 of the capsule 14 to adjust the rotational, forward 52, and/or rearward 54 movement of the capsule 14 based on an input. In one embodiment, adjusting the movement of the capsule may involve adjusting the speed of the forward 52, rearward 54, and/or rotational movement of the capsule 14.

With the foregoing in mind, FIG. 6 illustrates a flow chart of a method 80 for completing a ride cycle of the capsule ride system 10, in accordance with embodiments described herein. Although the following description of the method 80 is described in a particular order, which represents a particular embodiment, it should be noted that the method 80 may be performed in any suitable order, and steps may be added or omitted.

With the capsule 14 in the open position, as displayed in FIG. 2, passengers may load into the restraint 28 located on the platform 22 within the inner chamber of the drum 20, as described in block 82. After the restraints 28 are secure for each passenger on the platform 22, the platform 22 may move relative to the drum 20 of the capsule 14 from the open position depicted in FIG. 2 to the closed position depicted in FIG. 3, as described in block 84. Further, this portion of the method 80 may involve the platform 22 locking via the lock mechanism 24 to securely seal the capsule 14 in the closed position. With the capsule 14 properly closed or locked in a closed position, the drive system 34 may drive forward 52 and/or rearward 54 movement of the capsule 14 along the track 12, as described in block 86. Further, block 88 may occur simultaneously with and/or separately from block 86 so that the drive system 34 may cause the capsule 14 to rotate about the central axis 46. Block 90 may occur in conjunction with block 86 and/or block 88 so that as the capsule 14 moves relative to the track 12 and/or about the central axis 46, the screens 58 and/or speakers (or other effects) may provide images, sound and/or other media that may correlate to the motion of the capsule 14 and/or the track 12. As described earlier, this media may be presented in the form of a narrative that relates to the motion of the capsule 14 and/or track 12, such as a plane in flight. As noted above, the ride operator and/or the passengers may provide inputs that are processed by a processor to customize aspects of the ride experience, such as the speed of movement, frequency of rotations, and media, for example. When the capsule 14 has completed the course of the track 12, the platform 22 may unlock from the locking mechanism 24 and move relative to the drum 20 from the closed position to the open position, as described in block 92. Further, at block 94, the restraints 28 on the passengers may release to allow the passengers to unload from the platform 22 and exit the capsule 14. Block 94 may also include the battery 42 recharging via induction charging. The method 80 may then repeat as new passengers are loaded into the platform 22 of the capsule 14 while it is in the open position.

The present disclosure is not limited in its application to the details of construction and arrangements of the components set forth herein. Variations and modifications of the foregoing are within the scope of the present disclosure. The present disclosure extends to all alternative combinations of two or more of the individual features mentioned or evident from the text and/or the drawings. All of these different combinations constitute various alternative aspects of the present disclosure. While only certain features of the present disclosure have been illustrated and described herein, many modifications and changes will occur to those skilled in the art. It is, therefore, to be understood that the appended claims are intended to cover all such modifications and changes as fall within the true spirit of the present disclosure.

The invention claimed is:

1. A system, comprising:

a capsule;

a drum of the capsule comprising a wall defining a chamber;

a platform of the capsule supporting a restraint for a passenger and configured to fit within the chamber; and a drive system configured to drive rotation of the capsule about a central axis of the capsule and to drive at least forward or rearward movement of the capsule along a closed loop track, wherein the central axis of the capsule is parallel to a direction of travel of the forward or rearward movement of the capsule along the closed loop track.

2. The system of claim 1, wherein the platform is supported on a platform track within the drum.

3. The system of claim 2, wherein the capsule comprises an additional drive system configured to drive movement of the platform along the platform track to adjust the platform between an open position and a closed position relative to the drum.

4. The system of claim 1, wherein the capsule comprises a lock assembly configured to lock the platform in a closed position within the drum.

5. The system of claim 4, wherein the lock assembly comprises a power source configured to provide power to a lock of the lock assembly to maintain the lock in a locked position and a biasing member configured to drive the platform from the closed position to the open position in response to an interruption in power from the power source.

6. The system of claim 1, comprising a screen positioned with the drum, wherein the screen is configured to display an image.

7. The system of claim 6, wherein the screen comprises a curved screen coupled to an inner surface of the drum.

8. The system of claim 1, comprising a counter-balance configured to facilitate rotation of the capsule.

9. The system of claim 1, comprising a controller configured to receive an input from an input device and configured to control the drive system to adjust a parameter related to movement of the capsule based on the input.

10. The system of claim 9, wherein the parameter comprises a frequency of rotation of the capsule, a rate of rotation of the capsule, a speed of movement of the capsule along the closed loop track, or any combination thereof.

11. The system of claim 1, wherein the drive system comprises a frame supporting a first rolling element that is configured to contact a radially-outer surface of the drum to drive rotation of the capsule about the central axis.

12. The system of claim 11, wherein the frame of the drive system supports a second rolling element that is configured to contact an inner surface of the closed loop track to drive at least forward or rearward movement of the capsule relative to the closed loop track.

13. The system of claim 1, wherein the drive system comprises a spherical induction motor.

14. A system, comprising:

a closed loop track;

a capsule comprising a passenger restraint and a screen configured to display an image to a passenger supported by the restraint; and a drive system configured to drive rotation of the capsule about a central axis of the capsule and to drive at least forward or rearward movement of the capsule along the closed loop track, wherein the central axis of the capsule is parallel to a direction of travel of the forward or rearward movement of the capsule along the closed loop track.

15. The system of claim 14, wherein the capsule comprises:

a drum defining a chamber, wherein the drum comprises a door flush with an outer wall of the drum; and a platform configured to support the passenger restraint.

16. The system of claim 14, wherein the screen comprises a curved screen positioned on an inner surface of the capsule.

17. The system of claim 14, comprising a controller configured to receive an input from an input device and to control the drive system to adjust a parameter related to movement of the capsule based on the input, or select the image from a database based on the input.

18. The system of claim 14, comprising a battery configured to be charged via induction and configured to supply power to the drive system.

19. The system of claim 14, wherein the capsule comprises:

a platform configured to support the passenger restraint; and a plurality of actuators configured to contact the platform to drive movement of the platform relative to the capsule.

20. A method, comprising:

positioning a platform supporting a passenger restraint within a chamber defined by a wall of a capsule;

driving at least forward or rearward movement of the capsule along a closed loop track using a drive system; and driving rotation of the capsule about a central axis of the capsule using the drive system, wherein the central axis of the capsule is parallel to a direction of travel of the forward or rearward movement of the capsule along the closed loop track.

21. A system, comprising:

a capsule;

a drum of the capsule comprising a wall defining a chamber;

a platform of the capsule supporting a restraint for a passenger and configured to fit within the chamber, wherein the platform is supported on a platform track within the drum; and a drive system configured to drive rotation of the capsule about a central axis of the capsule and to drive at least forward or rearward movement of the capsule along a track, wherein the central axis of the capsule is parallel to a direction of travel of the forward or rearward movement of the capsule along the track.

22. A system, comprising:

a capsule;

a drum of the capsule comprising a wall defining a chamber;

a platform of the capsule supporting a restraint for a passenger and configured to fit within the chamber;

a lock assembly configured to lock the platform in a closed position within the drum; and a drive system configured to drive rotation of the capsule about a central axis of the capsule and to drive at least forward or rearward movement of the capsule along a track.

23. A system, comprising:

a capsule;

a drum of the capsule comprising a wall defining a chamber;

a platform of the capsule supporting a restraint for a passenger and configured to fit within the chamber; and a drive system configured to drive rotation of the capsule about a central axis of the capsule and to drive at least forward or rearward movement of the capsule along a track, wherein the drive system comprises a frame supporting a first rolling element that is configured to contact a radially-outer surface of the drum to drive rotation of the capsule about the central axis.

* * * * *